US008790560B2

(12) United States Patent
Asano et al.

(10) Patent No.: US 8,790,560 B2
(45) Date of Patent: Jul. 29, 2014

(54) PROCESS FOR MAKING MOLDS

(75) Inventors: Norihiro Asano, Toyokawa (JP); Yusuke Kato, Toyokawa (JP)

(73) Assignee: Sintokogio, Ltd., Aichi (JP)

( * ) Notice: Subject to any disclaimer, the term of this patent is extended or adjusted under 35 U.S.C. 154(b) by 1189 days.

(21) Appl. No.: 12/094,355

(22) PCT Filed: Nov. 16, 2006

(86) PCT No.: PCT/JP2006/322850

§ 371 (c)(1),
(2), (4) Date: Jun. 10, 2009

(87) PCT Pub. No.: WO2007/058254

PCT Pub. Date: May 24, 2007

(65) Prior Publication Data

US 2010/0140823 A1 Jun. 10, 2010

(30) Foreign Application Priority Data

Nov. 21, 2005 (JP) ..... 2005-335464

(51) Int. Cl.
*B22C 9/00* (2006.01)

(52) U.S. Cl.
USPC ..... 264/219; 264/128; 264/109

(58) Field of Classification Search
CPC ..... B22C 1/26
USPC ..... 264/219, 128, 109
See application file for complete search history.

(56) References Cited

U.S. PATENT DOCUMENTS 5,077,323 A * 12/1991 Johnson et al. ..... 523/145
2006/0071364 A1 4/2006 Zenpo et al.

FOREIGN PATENT DOCUMENTS

| | | | |
|---|---|---|---|
| EP | 1 561 527 | A | 8/2005 |
| GB | 1 279 979 | A | 6/1972 |
| JP | 53-99033 | A | 8/1978 |
| JP | 2-280940 | A | 11/1990 |
| WO | WO 2004/041460 | A1 | 5/2004 |

* cited by examiner

*Primary Examiner* — Galen Hauth
(74) *Attorney, Agent, or Firm* — Finnegan, Henderson, Farabow, Garrett & Dunner, L.L.P.

(57) ABSTRACT

A process for making molds which do not generate toxic gas in pouring a molten metal into the molds equipped with casting cores or the like even when the binder contained therein decomposes and which are excellent in disintegration characteristics after casting. The process includes mixing a particulate aggregate with one or more water-soluble binders, a surfactant, a crosslinking agent and water under stirring and foaming to prepare a foamed aggregate mixture, charging the foamed aggregate mixture into a mold-foaming cavity, solidifying the charged mixture by evaporating the water contained in the mixture to form a mold, and taking the mold out of the cavity.

10 Claims, 3 Drawing Sheets

PROCESS FOR MAKING MOLDS

FIELD OF THE INVENTION

This invention relates to a process for making a mold. More particularly, this invention relates to a process for making a mold that is to be made from a foamed mixture in which a granular aggregate, a water-soluble binder, a surfactant, and water are stirred to cause it to foam such that the mold has a high strength and offers resistance to high temperatures and generates little unpleasant odors.

BACKGROUND OF THE INVENTION

One example of conventional molding processes for making a hollow core is disclosed in Japanese Patent Early-Publication No. 63-115649. The method employs uncured molding sand (a granular mixture) that is composed of silica sand as an aggregate granular material and a binder. The method includes the steps of adding a solution of a surfactant to the uncured molding sand and stirring it to cause the aggregate granular material to foam, injecting the foamed aggregate granular material mixture into a heated metal mold, and maintaining the injectant in the heated metal mold for a predetermined time to evaporate the moisture therefrom.

As a binder usable for the method, the above publication describes a phenolic resin. Using the phenolic resin, however, produces harmful gases, e.g., formaldehyde, a phenol, and ammonia. They impose a biohazard for humans and involve an unpleasant odor when the binder is to be hardened by the heat transferred from the metal mold.

DISCLOSURE OF THE INVENTION

Accordingly, one object of the invention is to provide a molding process for making a mold. The molding process of the present invention inhibits the generation of harmful gases, which pose a biohazard for humans and involve an unpleasant odor. They are caused because a binder is decomposed when an aggregate granular material that includes sand and the binder is used for the molding process, or when a molten metal is poured into the mold (such as a core) that is made from the aggregate granular material. Further, the mold that is made by the molding process of the present invention has a better collapsibility after casting.

Further, a part of the object of the present invention is to provide a molding process that is capable of making a mold with enhanced strength.

The present invention provides a molding process that comprises the steps of mixing, stirring, and foaming granular aggregate material, one or more kinds of water-soluble binders, a surfactant, a cross-linker, and water to prepare a foamed aggregate mixture; filling a molding space with the foamed aggregate mixture; vaporizing moisture in the filled aggregate mixture such that the aggregate mixture is cured to make a mold from it and removing the mold from the metallic mold.

Preferably, the surfactant is one that causes a cross-linking reaction with the cross-linker.

Preferably, the surfactant is nonionic and one whose HLB value is 8 or more, but less than 20. The HLB value is an index that denotes the level of affinity with water or an oil, which is an organic compound having no solubility in water, of a surfactant. The HLB value has a range from 0 to 20. The affinity with the oil is increased as it nears 0, whereas that to the water is increased as it nears 20. The HLB value may be derived by a calculation based on the Atlas method or the Griffin method. The HLB value may also be determined by the holding time by using high-performance liquid chromatography. No foamed aggregate mixture can be obtained if the nonionic surfactant has an HLB value of below 8. This is because such a nonionic surfactant is difficult to be distributed in water, and causes insufficient foam. If the nonionic surfactant has an HLB value of 8 or more, it is steadily distributed into water to cause sufficient foam. Thus a foamed aggregate mixture can be obtained.

The molding space may be defined by a metal mold. In this case, the filling step preferably includes a step for filling the foamed aggregate mixture in the molding space by pressurizing it.

The pressurized filling step may include a step for charging the foamed aggregate mixture into a cylinder and then filling it in the molding space by directly pressurizing it. Alternatively, the pressurized filling step may include a step for filling the foamed aggregate mixture in the molding space by pressurizing it with a compressed gas.

In the vaporizing step, the moisture in the foamed aggregate mixture is preferably vaporized by means of the heat of the metal mold that is heated.

Each water-soluble binder is soluble in water of normal temperature.

Each water-soluble binder is a saccharide or its derivative.

One or more kinds of water-soluble binders are contained in 0.1 to 5.0 wt % per 100 wt % of the granular aggregates.

Preferably, the cross-linker is a chemical compound having a carboxyl group. The chemical compound having the carboxyl group is selected from a group that includes an oxalic acid, a maleic acid, a succinic acid, a citric acid, a butane-tetra carboxylic acid, a methyl vinyl ether-maleic anhydride co-polymer, and an isobutylene-maleic anhydride co-polymer.

With the present invention, the foamed aggregate mixture is prepared by mixing granular aggregate material, one or more kinds of water-soluble binders, a surfactant, and a cross-linker that causes a cross-linkage reaction with the water-soluble binders. Because the foamed aggregate mixture can be filled in a molding space (or a molding cavity) in every part, and the quantity of gases generated from a mold when a molten metal is poured therein, can be inhibited, any defect caused by gas in the mold can be reduced.

Because the foamed aggregate mixture includes no phenolic resin such as exists in the prior art, the generation of harmful gases that impose a biohazard for humans and involve an unpleasant odor is prevented, even if each binder is decomposed when the foamed aggregate mixture is molded or when the molten metal is poured into a mold (e.g., a core mold) made from the aggregate mixture.

Further, a mold having a high-collapsibility can be produced.

The strength of the mold (the core) that is produced using an anion surfactant, a cationic surfactant, and an amphoric surfactant becomes undesirably lower than that of one produced using a nonionic surfactant. Accordingly, the present invention uses the nonionic surfactant to enable the foamed aggregate mixture to be filled in the molding space in every area and to provide a sufficient strength and resistance to humidity to the resulting mold.

The above and further characteristics and advantages of the present invention will be further clarified by the following detailed description, by refers to the accompanying drawings.

THE PREFERRED EMBODIMENTS OF THE PRESENT INVENTION

Figure 1:
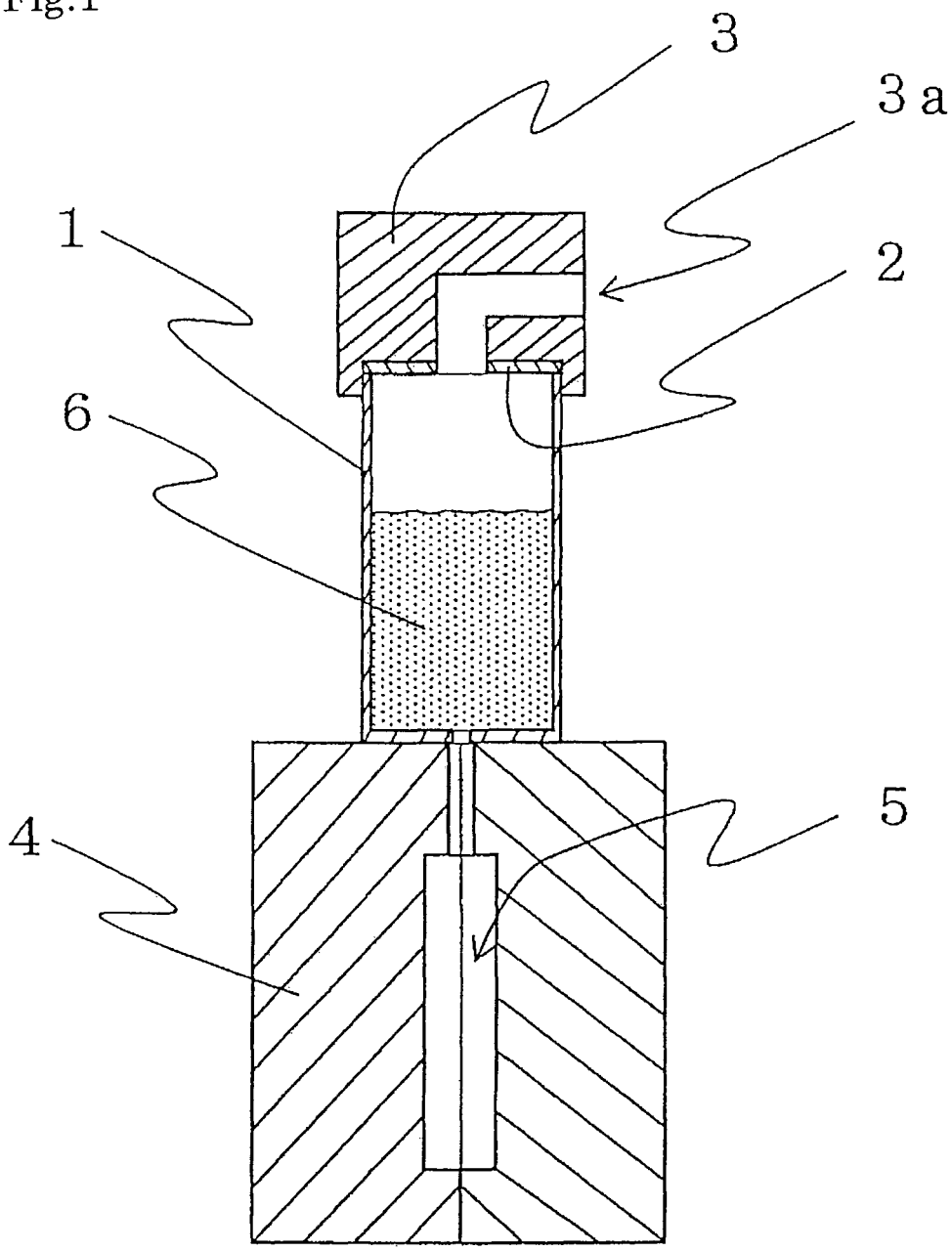
FIG. 1 is a longitudinal sectional view of a molding machine used for the first embodiment of the molding process of the present invention.

Below the molding process of the present invention will be explained. It comprises the steps of preparing and stirring an aggregate mixture that includes an aggregate granular material, one or more kinds of a water-soluble binder, an interfacial active agent, a cross-linking agent, and water, to cause it foam, filling the foamed mixture into a molding space, evaporating the moisture within the filled mixture to harden the charged mixture to make a mold, and removing the resulting mold from the molding space.

The aggregate granular material in the present invention is a heat-resistant granular material that comprises at least one material selected from a group comprising silica sand, alumina sand, olivine sand, chromite sand, zircon sand, mullite sand, any one of artificial aggregate materials, and so forth.

Each water-soluble binder in the present invention is soluble in water of normal temperature, and acts as a binder that hardens by evaporating the moisture. It also acts as a thickening agent to adjust the viscosity of an aggregate mixture that is kneaded and foamed. The thickening agent means a high polymer that dissolves or is distributed in water to render it viscid, and is also called an adhesive paste. The water-soluble binder may be a sugar group that includes, in particular, starch or its derivatives, polysaccharides such as saponins, or dissaccharides such as sugar.

The water-soluble binder that is soluble in water of normal temperature can be mixed into a foamed aggregate mixture without heating it and the water. A water-soluble binder having no water-solubility at normal temperatures cannot be mixed unless it and water are heated. To use such a water-soluble binder having no water-solubility at normal temperatures, it may be once heated and then mixed to prepare a water-soluble binder solution that is cooled to a normal temperature.

The starch is, e.g., a dextrin or α-starch that is derived from potatoes, or corn, or tapioca, or flour. The starch derivative is, e.g., etherificated starch, esterificated starch, or a bridging starch. The sugar is a saccharose that is a saccharide in which a pair of fructose molecules and a pair of glucose molecules are bonded. Examples of a saccharide include white sugar and granulated sugar. The water-soluble binders to be used in the present invention are readily available. In particular, α-starch, dextrin, and sugar are available at low costs. α-starch, dextrin or its derivatives, saponins, and a sugar are soluble in water of normal temperature. Examples of the thickening agent include a starch, a xanthan gum, a guar gum, an Arabic gum, etc.

Because the decomposition temperature of the water-soluble binder used in the invention is lower than that of a phenol resin, a mold made by the method of the present invention can be readily decomposed by the heat of the casting process. Thus a mold having a high-collapsibility after the casting process is finished can be obtained.

The aggregate granular material preferably contains the water-soluble binder from 0.1 to 5.0 wt % based on the total weight of the aggregate granular material. This is because a mold having insufficient strength is provided if the content is less than 0.1 wt %, and a mold having redundant strength is produced if the content exceeds 5.0 wt %.

With the mold of the present invention, adding the cross-linker results in cross-linking reactions with the water-soluble binder enhancing the bonding between the aggregate granular material particles that are coated by the water-soluble binder. Further, there is less possibility of the water-soluble binders reacting with water molecules, thus providing the resulting mold with a sufficient property even in a high-humidity environment.

The aggregate granular material preferably contains the added surfactant from 0.01 to 1.0 wt % based on the total weight of the aggregate granular material. This is because no aggregate mixture having enough foam is provided and thus no foamed aggregate mixture is provided if the content is less than 0.01 wt %. The foamed aggregate mixture has a sufficient fluidity if the content is 1.0 wt %.

The cross-linker that may be used in the present invention includes a compound having a carboxyl group that includes one such as oxalic acid, or maleic acid, or succinic acid, or citric acid, all of which cause a cross-linking reaction by an ester-link. Alternatively, the cross-linker may include a methyl vinyl ether-maleic anhydride copolymer and an isobutylene-maleic anhydride copolymer that has a carboxyl group when it is the phase of a water solution. One preferable cross-linkage that may be used in the present invention is a cross-linker that causes the ester bonding to generate less harmful gas, i.e., one having a carboxyl group.

In the present invention, the added quantity of the cross-linker is from 5 to 300 wt % based on the total weight of the total water soluble binder content. This is because no mold having enough strength in a high-humidity environment can be produced if the added quantity of the cross-linker is less than 5 wt %, whereby the advantage of the cross-linkage reaction is insufficient. Although a resulting mold having enough strength in the high-humidity environment can be produced if the added quantity of the cross-linker exceeds 300 wt % based on the total weight of the total water soluble binder content, its advantage is not more remarkable than when the added quantity of the cross-linker is 300 wt %. Thus, adding the cross-linker exceeding 300 wt % may be an uneconomic and an undesirable practice.

In the present invention, the cross-linker is used as an aqueous solution. For, example, its density may be more than 10 wt % if the cross-linker is butane tetra carboxylic acid, or citric acid, or a methyl vinyl ether-maleic anhydride copolymer.

In the present invention, the foamed aggregate mixture may be injected into a cylinder by directly pressurizing it, or it may be pressurized by air such that a molding space is filled with the foamed aggregate mixture. The direct pressurizing by the cylinder is to inject the mixture within the cylinder for receiving the mixture into a metal mold by directly pressurizing the mixture by press-fitting a plunger (or a piston) of a pressing mechanism into the cylinder.

The direct pressurizing by the compressed air, as is, for example, shown in FIG. 1, instead of the piston in the above direct pressurizing by the cylinder. In this arrangement, a top opening of the cylinder (or the piston) 1 is provided with a hermetic seal 2 to close it so that it is airtight. The airtight space of the top of the cylinder 1 is also provided with a cover 3 that forms an air passageway 3*a* to connect it to a compressed air source to supply compressed air to the top face of the foamed aggregate mixture 6 within the cylinder 1 to inject it into a molding space 5 of the metal mold 4.

In the molding process of the present invention, to vaporize moisture in the foamed aggregate mixture that is filled in the molding space a metal mold or its associated member, or both, defining the molding space, may be heated to a high temperature, or heated vapor, steam or microwaves may irradiate the foamed aggregate mixture, or the molding space that is filled with the foamed aggregate mixture may be left under a vacuum environment. Alternatively, the molding space may receive a through-flow therein, if desired.

In vaporizing the moisture in the foamed aggregate mixture by the metal mold that is heated to the high temperature, the foam and the moisture both have been distributed in the aggregate mixture by stirring and they are moved to the center of the mold that is made from the aggregate mixture by means of the heat of the metal mold. Thus, the density of the aggregate material to be filled at the center of the mold is lowered. A mold having a low density at its center causes the quantities of the granular aggregate and the water-soluble binder(s) that are to be reduced. Also, it causes gases generated with the decomposition of the water-soluble binder(s) to be readily exhausted, since such a mold tends to have many holes.

The surfactant in the present invention may generally be classified into four kinds, by the dissociative states of its molecules when it is dissolved in water: an anion surfactant, a cationic surfactant, a nonionic surfactant, and an amphoric surfactant. The chemical definition of a surfactant is "a material to mix water and oil." A surfactant has both a hydrophobic group and a hydrophilic group within the molecules, and is dissolved or dispersed in a liquid such as water or oil, and adsorbs the interface selectively. Therefore, the surfactant in the present invention causes forming, or bubbling.

The mold (core) made by using the anion surfactant, the cationic surfactant, or the amphoric surfactant, among the four kinds of surfactants, causes no cross-linking reaction with the cross-linker because those surfactants have no hydroxyl group in the molecules, as discussed below. In this case, mold having an insufficient strength can thus be made. In contrast, the mold produced by using the nonionic surfactant has a sufficient strength, since three-dimensional networks in the molecules of the water-soluble binder(s) and the surfactant are formed by a cross-linkage reaction in which a carboxyl group (COOH) in the molecules of the cross-linker and hydroxyl (OH), which is a hydrophilic group, are ester bonded.

Accordingly, the nonionic surfactant is preferably used in the present invention to make a mold having a sufficient strength.

Adding the nonionic surfactant that acts as the cross-linker to cause the cross-linkage reaction with the water-soluble binder(s) enhances the binding of the granular aggregate particles that are coated with the water-soluble binder(s). Further, because the reaction between the water-soluble binder(s) and the water molecules can be inhibited, the resulting mold can maintain sufficient properties under a high humidity environment.

Although examples of the nonionic surfactant include a sucrose fatty acid ester, a sorbitan fatty acid ester, a polyoxyethylene sorbitan fatty acid ester, a fatty alkanol amide, a polyoxethylene alkyl ether, polyoxyethylene alkyl phenyl ether, a glycerin fatty acid ester, a propylene glycol fatty acid ester and so on, and, one having a HLB value of 8 or more is used among them. Preferably, a natural coconut oil or a palm oil that is made from a vegetable oil has a high safety, and is harmless in practical use.

The following embodiments are intended to explain, but do not limited, the molding process of the present invention.

The First Embodiment

TABLE 1

| Composition (except water) of the Aggregate Mixture 11 | |
|---|---|
| Silica sand (Flattery sand): | 100 wt % |
| Starch (Dextrin NSD-L, made by Nissi Co., Ltd., Japan): | 1.0 wt % |
| Surfactant (polyglycerol fatty acid ester): | 0.03 wt % |
| Citric acid (made by Fuso Chemical Co., Ltd., Japan): | 0.5 wt % |

Figure 2:
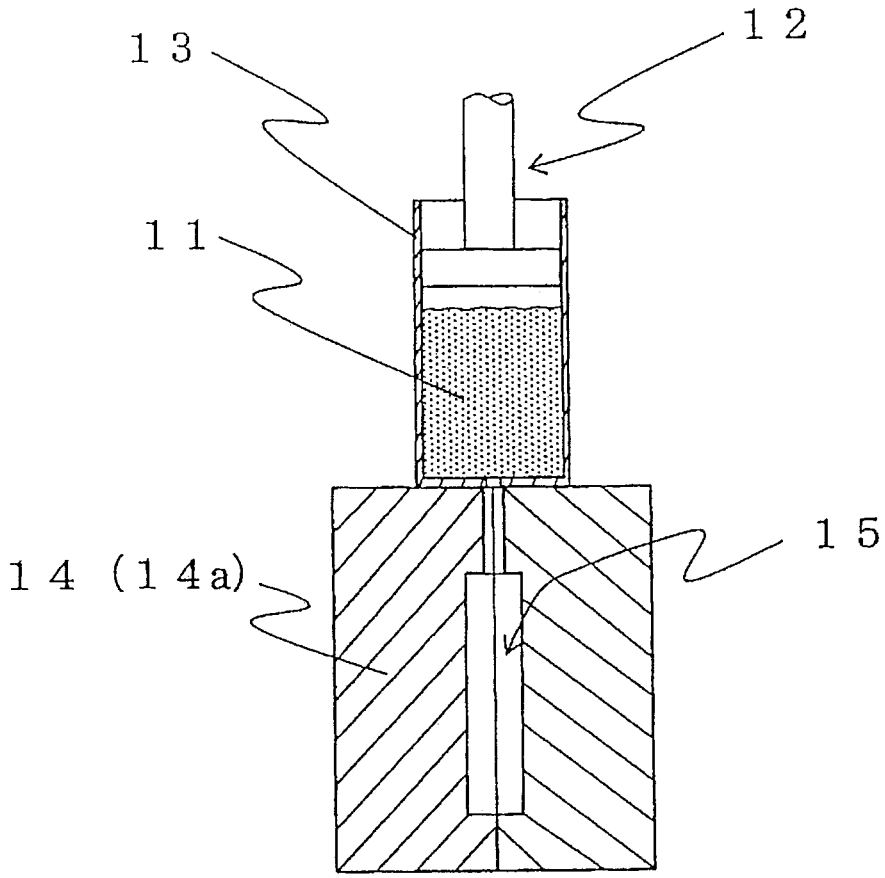
FIG. 2 is a longitudinal sectional view of the molding machine used for another embodiment of the molding process of the present invention.

In the first embodiment, the aggregate mixture that is composed as shown in Table 1 and water of 4 wt % are mixed and stirred with a mixing machine (a desktop mixer, made by Aikohsha Manufacturing Co., Ltd., Japan) at 200 rpm for about 5 minutes. Thus it foams, to prepare a foamed aggregate mixture 11. The foamed aggregate mixture 11 is then poured into a cylinder 13 of a plunger 12, as shown in FIG. 2. This foamed aggregate mixture is then pressurized with about 0.4 MPa of the surface pressure by the cylinder such that it is pressure-charged into a molding space 15 with a capacity of about 80 $cm^3$ in a metal mold for bending test 14, which is maintained at a temperature of 250° C. (the filling step).

The foamed aggregate mixture in the heated metal mold is held for about 2 minutes to vaporize moisture by heat therefrom such that the foamed aggregate is hardened (the hardening step). The mold is removed from the molding space 15 of the metal mold 14 after causing the cross-linking reaction between the water-soluble binder and the cross-linker. Two specimens to use for a bend test method are prepared. The specimens are held for 24 hours in respective humidity baths at a humidity of 30% and at a humidity of 90% or more, and then they are bending tested. As a result, strengths of 4.9 MPa and 2.3 MPa were measured at a humidity of 30% and at a humidity of 98%, respectively. Because the bending strength of 4.9 MPa at a humidity of 30% approximately equals that of a mold that is produced from a shell molding (see JFS Foundry Engineer's Handbook, Section 2.1, "Shell Molding"), the normal operation of the mold involves no significant problem. If the mold has a strength of 2 MPa or more after it held for 24 hours in a humidity of 90% or more, a normal handling of the mold involves no significant problem, and it can be used as a mold.

The Second Embodiment

TABLE 2

| Composition (except water) of the Aggregate Mixture | |
|---|---|
| Synthetic sand (Espar # 60 made by Yamakawa Sangyo Co., Ltd., Japan): | 100 wt % |
| Starch (Dextrin NSD-L, made by Nissi Co., Ltd., Japan): | 1.0 wt % |
| Surfactant (polyglycerine fatty acid ester): | 0.03 wt % |
| Citric acid (made by Fuso Chemical Co., Ltd., Japan): | 0.5 wt % |

In the second embodiment, the aggregate mixture that is composed as shown in Table 2 and water of 2.5 wt % are mixed and stirred with a mixing machine (a desktop mixer, made by Aikohsha Manufacturing Co., Ltd., Japan) at 200 rpm for about 5 minutes and thus foams it to prepare a foamed aggregate mixture (the preparation step). The foamed aggregate mixture is then poured into the cylinder 13, as shown in FIG. 2. This foamed aggregate mixture is then pressurized with about 0.4 MPa of a surface pressure of the cylinder such that it is pressure-charged into the molding space 15 with a capacity of 80 $cm^3$ in the metal mold for bending test 14, which is maintained at a temperature of 250° C. (the filling step). The foamed aggregate mixture in the heated metal mold is held for 90 seconds to vaporize the moisture by heat therefrom such that the foamed aggregate is hardened (the molding step). The mold is removed from the molding space 15 of the metal mold 14 as two specimens, after causing the cross-linking reaction between the water-soluble binder and the cross-linker. Both specimens are held for 24 hours in a humidity bath at a humidity of 30% and at a humidity of 90% or more, and then they are bending-tested. As a result, strengths of 9.5 MPa and 3 MPa were measured at a humidity of 30% and at a humidity of 98%, respectively. With these values, a normal handling of the mold involves no significant problem, and it can be used for as the mold.

The Third Embodiment

TABLE 3

| Composition (except water) of the Aggregate Mixture | |
|---|---|
| Silica sand (Flattery sand): | 100 wt % |
| Starch (Dextrin NSD-L, made by Nissi Co., Ltd., Japan): | 1.0 wt % |
| Surfactant (polyglycerine fatty acid ester): | 0.03 wt % |
| Citric acid (made by Fuso Chemical Co., Ltd., Japan): | 0.5 wt % |

In the third embodiment, the aggregate mixture that is composed as shown in Table 3 and water of 4.5 wt % are mixed and stirred with a mixing machine (a desktop mixer, made by Aikohsha Manufacturing Co., Ltd., Japan) at 200 rpm for about 5 minutes and thus foams it to prepare a foamed aggregate mixture. The foamed aggregate mixture is then poured into the cylinder 13, as shown in FIG. 2. This foamed aggregate mixture is then pressurized with about 0.4 MPa of the surface pressure by the cylinder such that it is pressure-charged into a molding space 15 with a capacity of about 140 $cm^3$ in a metal mold 14*a*, which is maintained at a temperature of 270° C. (the filling step). The foamed aggregate mixture in the heated metal mold is held for 90 seconds to vaporize the moisture by heat therefrom such that the foamed aggregate is hardened (the molding step). The mold as a specimen A is removed from the molding space 15 of the metal mold 14*a* (the removing step).

The surface layer of the removed specimen was scraped with a metallic file to a depth of 1 mm to take a sample of about 1 gram. The quantity of any cracked gas is derived based on the method for converting a gas pressure to a capacity according to the method of measuring the amount of the generated gas by using the JACT examination standard M-5, which is defined by the Japan Association of Casting Technology to calculate molecular weights. Table 4 shows this result.

TABLE 4

| | The quantity of a cracked gas (cc/g) |
|---|---|
| The specimen A | 18 |

The Fourth Embodiment

Figure 3:
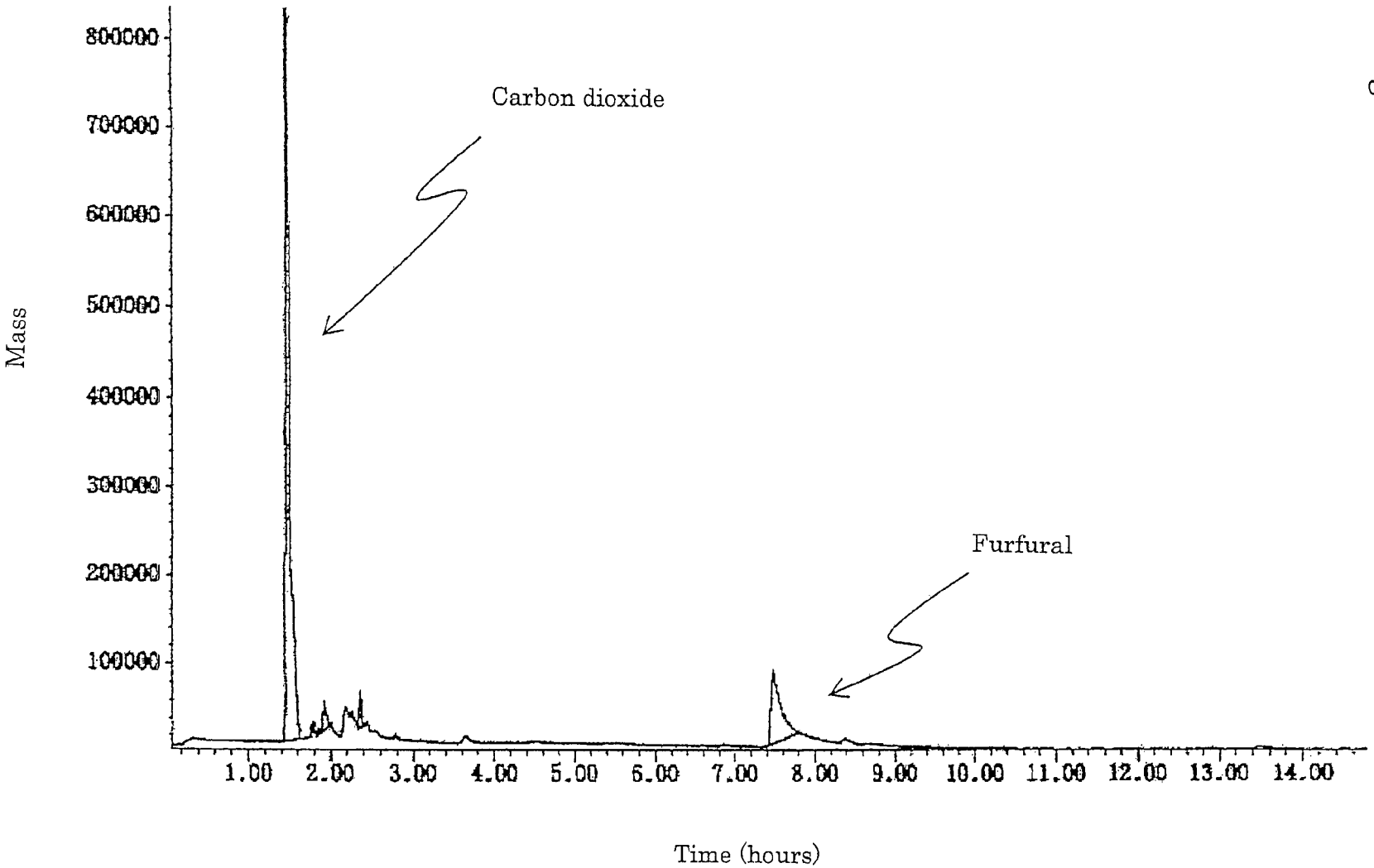
FIG. 3 illustrates the results of an analysis where components of gases that are generated from a binder in the molding process of the present invention were analyzed by a mass spectrometer.

A mixture in which a starch (Dextrin NSD-L, made by Nissi Co., Ltd., Japan), a surfactant (polyglycerine fatty acid ester), and citric acid (made by Fuso Chemical Co., Ltd., Japan) are mixed in ratios of 1:0.3:5 is held in a high temperature, furnace of 250° C., for 10 minutes, and then removed. The removed mixture is held for five seconds under a helium atmosphere in a pyrolizer at 590° C. Pyrolysis gas is held for 10 minutes at 50° C., and is heated to 240° C. at the heating rate 10° C./min. The kind of gas is analyzed with a mass spectrometer, while the heated gas passing through a column under the temperature of 240° C. is held for 15 minutes. As shown in FIG. 3, carbon dioxide and furfural are detected as a result of analyzing the components of the pyrolysis gas from the binder with the mass spectrometer. In the conventional shell molding process, unpleasant odors such as ammonia, formaldehydes, and phenols, which are sources of odors, are generated by the pyrolysis of a phenolic resin and hexamin (a curing agent) when a core is baked. In contrast, it is found that those gases are not generated from the mold of the present invention.

The Fifth Embodiment

In the fifth embodiment, experiments are performed to confirm whether various types of the surfactants cause cross-linking reactions with a cross-linker.

TABLE 5

| Composition of the Aggregate Mixture | |
|---|---|
| Silica sand (Flattery sand): | 100 wt % |
| Nonionic Surfactant (a polyglycerine fatty acid ester): | 0.03 wt % |
| Citric acid (made by Fuso Chemical Co., Ltd., Japan): | 0.5 wt % |

The aggregate granular material as shown in Table 5 and water are mixed and stirred with a mixing machine (a desktop mixer, made by Aikohsha Manufacturing Co., Ltd., Japan) at 200 rpm for about 5 minutes. Thus it is foamed to prepare a foamed aggregate mixture. The foamed aggregate mixture is manually filled in a metal mold that is adapted to prepare a specimen for bending test and is defined by the JACT examination M-1 (the filling step). The metal mold is then held in a constant-temperature bath for 45 minutes to dry and cure the foamed aggregate mixture (the molding step). The resulting mold as a specimen for bending test is then removed. For a comparison, reference specimens are prepared in the same manner from the composition as shown in Table 5. However, instead of the nonionic surfactant in that composition, the respective reference specimens include an anion surfactant (alkyl ether sulfate esther sodium), a cationic surfactant (alkyl trimethyl ammonium salt), and an amphoric surfactant (alkyl amine oxide). The bending test specimen and the reference specimens are held in a humidity bath at a humidity of 30%. Then their bending strengths are measured. Table 6 shows these results.

TABLE 6

| Surfactant | | Cross-linker | | Bending |
|---|---|---|---|---|
| Kind | Additive Amount | Kind | Amount of Additive | Strength (MPa) Humidity 30% |
| Nonionic Surfactant (Polyglycerine fatty acid ester) | 1.0 | Citric acid | 0.5 | 3.0 |
| Anion Surfactant (Alkyl ether sulfate ester sodium) | 1.0 | Citric acid | 0.5 | 0 |
| Cationic Surfactant (Alkyl trimethyl ammonium salt) | 1.0 | Citric acid | 0.5 | 0 |

TABLE 6-continued

| Surfactant | | Cross-linker | | Bending |
|---|---|---|---|---|
| Kind | Additive Amount | Kind | Amount of Additive | Strength (MPa) Humidity 30% |
| Amphoric Surfactant (Alkyl amine oxide) | 1.0 | Citric acid | 0.5 | 0 |

Table 6 denotes that the nonionic surfactant is one that causes a cross-linkage reaction with a cross-linker that has a carboxyl group. The mold using other surfactants collapsed when it was removed from the metal mold. Thus it has no practical strength.

The Sixth Embodiment

TABLE 7

| Composition of the Aggregate Mixture | |
|---|---|
| Silica Sand (Flattery Sand): | 100 wt % |
| Starch (Dextrin NSD-L, made by Nissi Co., Ltd., Japan): | 1.0 wt % |
| Respective Nonionic Surfactants as shown in Table 8: | 0.03 wt % |
| Citric acid (made by Fuso Chemical Co., Ltd., Japan): | 0.5 wt % |

The aggregate granular material as shown in Table 7 and water were mixed and stirred with a mixing machine (a desktop mixer, made by Aikohsha Manufacturing Co., Ltd., Japan) at 200 rpm for about 5 minutes. Visual examinations were performed to confirm that the foamed aggregate mixtures were obtained. Table 8 shows these results. In Table 8, "Excellent" denotes an excellent foamed aggregate mixture, "Good" denotes that a foamed aggregate mixture is obtained as it is in stirring, but its foam is immediately dissolved as stirring is stopped, and "Poor" denotes that no foamed aggregate mixture was obtained.

TABLE 8

| Nonionic Surfactant | HLB | Foamed Aggregate Mixture |
|---|---|---|
| Polyglycerine fatty acid ester | 15.5 | Excellent |
| Polyoxyethylene alkyl ether | 10.5 | Excellent |
| Sodium polyoxyethylene lauryl ether | 8.1 | Excellent |
| Sorbitan fatty acid ester | 6.7 | Good |

TABLE 8-continued

| Nonionic Surfactant | HLB | Foamed Aggregate Mixture |
|---|---|---|
| Sorbitan fatty acid ester | 5.0 | Poor, |
| Propylene glycol fatty acid ester | 3.9 | Poor, |

Table 8 shows that no foamed aggregate mixture can be obtained unless otherwise the HLB value of a nonionic surfactant to be used is 8 or more.

The Seventh Embodiment

TABLE 9

| Composition (except water) of the Aggregate Mixture | |
|---|---|
| Silica sand (Flattery sand): | 100 wt % |
| Starch (Dextrin NSD-L, manufactured by Nissi Co., Ltd., Japan): | 1.0 wt % |
| Nonionic Surfactant (Sunsoft M-12, manufactured by Taiyo Kagaku Co., Ltd., Japan): | 0.03 wt % |
| Citric acid (manufactured by Fuso Chemical Co., Ltd., Japan): | 0.5 wt % |

In the seventh embodiment, the aggregate granular material as shown in Table 9 and water of 4 wt % were mixed and stirred with a mixing machine (a desktop mixer, made by Aikohsha Manufacturing Co., Ltd., Japan) at about 200 rpm for about 5 minutes and thus the resulting mixture was foamed to prepare a foamed aggregate mixture (the preparing step). As shown in FIG. 2, the foamed aggregate mixture 11 was then poured into the cylinder 13. This foamed aggregate mixture was then pressurized with about 0.4 MPa of the surface pressure by the cylinder such that it was pressure-charged into the molding space 15 with a capacity of about 80 $cm^3$ in the metal mold for bending test 14, which was maintained at a temperature of 250° C. (the filling step). The foamed aggregate mixture in the heated metal mold was held for 2 minutes to vaporize the moisture by heat therefrom such that the foamed aggregate was hardened (the molding step). The mold was removed from the molding space 15 of the metal mold 14 as a specimen. For a comparison, reference specimens were prepared in the same manner from the aggregate granular material as shown in Table 9. However, instead of the nonionic surfactant in that composition, the respective reference specimens included an anion surfactant, a cationic surfactant, and an amphoric surfactant. The bending test specimen and the reference specimens were held in both a humidity bath with a humidity of 30% for 24 hours, and a humidity bath with a humidity of 90% or more for 24 hours. Their bending strengths were then measured. Table 10 shows these results.

TABLE 10

| Surfactant | | Cross-linker | | Bending Strength (MPa) | |
|---|---|---|---|---|---|
| Kind | Amount of Additive | Kind | Amount of Additive | Humidity 30% | After being held in a humidity of 90% for 24 hours |
| Nonionic Surfactant (Polyglycerine fatty acid ester) | 0.03 | Citric acid | 0.5 | 4.9 | 2.3 |

TABLE 10-continued

| Surfactant | | Cross-linker | | Bending Strength (MPa) | |
|---|---|---|---|---|---|
| Kind | Amount of Additive | Kind | Amount of Additive | Humidity 30% | After being held in a humidity of 90% for 24 hours |
| Anion Surfactant (Alkyl ether sulfate ester sodium) | 0.03 | Citric acid | 0.5 | 2.5 | 1.1 |
| Cationic Surfactant (Alkyl trimethyl ammonium salt) | 0.03 | Citric acid | 0.5 | 2.4 | 1.2 |
| Amphoric Surfactant (Alkyl amine oxide) | 0.03 | Citric acid | 0.5 | 2.6 | 1.0 |

As seen from Table 10, molds with strengths of 4.9 MPa and 2.3 MPa were measured at a humidity of 30% and at a humidity of 98%, respectively. Because the bending strength of 4.9 MPa at a humidity of 30% approximately equals that of a mold that is produced from a shell molding (see Foundry Engineer's Handbook, Section 2.1, "Shell Molding"), the normal operation of the mold involves no significant problem. If the mold has a bending strength of 2 MPa after it held for 24 hours in a humidity of 90% or more, the normal handling of the mold involves no significant problem and it can be practically used as the mold.

In contrast, the bending strength of the mold that is produced using other surfactants was lower. Particularly, it was less than that of a mold that is produced by the conventional shell-molding process, since those surfactants cause no cross-linking reaction with the cross-linker. Further, it was also found that such a mold has an insufficient strength in a high-humidity environment.

With the molding process of the present invention, generation of any harmful gas, which poses a biohazard for humans and involves an unpleasant odor can be inhibited, if a binder is pyrolized when a molten metal is poured into the mold. Accordingly, the molding process of the present invention can be applicable to produce a light metal mold using, e.g., aluminum or magnesium. It should also be additionally appreciated that the number of fins for the mold that is produced by the molding process of the present invention can be remarkably reduced.

Because the forgoing embodiments are intended as illustrative and not to limit the scope of the present invention, those skilled in the art can thus conceive various changes and modifications in the embodiments within the scope of the appended claims.

The invention claimed is:

1. A molding process comprising the steps of:

mixing, stirring, and foaming granular, aggregate material, one or more kinds of water-soluble binders without a phenolic resin, a nonionic surfactant having a hydroxyl group, a cross-linker having a carboxyl group, and water to form a foamed aggregate mixture that includes the granular aggregate material coated with one or more kinds of the water-soluble binders;

filling a molding space in a metal mold with said foamed aggregate mixture by pressurizing said foamed aggregate mixture;

vaporizing moisture in said foamed aggregate mixture in said molding space of said metal mold by heating said metal mold such that the aggregate mixture is cured to produce a mold from the cured aggregate mixture; and removing said produced mold from said molding space.

2. The process of claim 1, wherein said nonionic surfactant having a hydroxyl group has a HLB value of 8 or more, but less than 20.

3. The process of claim 1, wherein said filling step includes a step of charging said foamed aggregate mixture into a cylinder, and filling said charged aggregate mixture into said molding space in said metal mold by directly pressurizing said charged aggregate mixture.

4. The process of claim 1, wherein said foamed aggregate mixture is pressurized with a compressed gas.

5. The process of claim 1, wherein each water-soluble binder is soluble in water of normal temperature.

6. The process of claim 1, wherein each water-soluble binder is a saccharide or a derivative thereof.

7. The process of claim 1, wherein said one or more kinds of water-soluble binders contain 0.1 to 5.0 wt % per 100 wt % of said granular aggregates.

8. The process of claim 1, wherein said cross-linker having a carboxyl group is a compound having a carboxyl group.

9. The process of claim 8, wherein said compound having the carboxyl group is selected from the group consisting of an oxalic acid, a maleic acid, a succinic acid, a citric acid, a butane-tetra carboxyl acid, a methyl vinyl ether-maleic anhydride co-polymer, and an isobutylene-maleic anhydride co-polymer.

10. The process of claim 1, wherein the granular aggregate material is at least one selected form the group consisting of silica sand, alumina sand, olivine sand, chromate sand, zircon sand and mullite sand.

* * * * *